US009761179B2

(12) United States Patent
Qi

(10) Patent No.: US 9,761,179 B2
(45) Date of Patent: Sep. 12, 2017

(54) ANTI-CROSSTALK METHOD AND APPARATUS FOR IMAGE OF 3D LIQUID CRYSTAL DISPLAY APPARATUS

(71) Applicant: SHENZHEN TCL NEW TECHNOLOGY CO., LTD., Guangdong (CN)

(72) Inventor: Yanxing Qi, Guangdong (CN)

(73) Assignee: SHENZHEN TCL NEW TECHNOLOGY CO., LTD., Shenzhen (CN)

( * ) Notice: Subject to any disclaimer, the term of this patent is extended or adjusted under 35 U.S.C. 154(b) by 0 days.

(21) Appl. No.: 14/787,036

(22) PCT Filed: Jul. 30, 2014

(86) PCT No.: PCT/CN2014/083276

§ 371 (c)(1),
(2) Date: Oct. 26, 2015

(87) PCT Pub. No.: WO2015/081710

PCT Pub. Date: Jun. 11, 2015

(65) Prior Publication Data

US 2016/0104433 A1 Apr. 14, 2016

(30) Foreign Application Priority Data

Dec. 3, 2013 (CN) ..... 2013 1 0642537

(51) Int. Cl.
*G09G 5/00* (2006.01)
*G09G 3/34* (2006.01)
(Continued)

(52) U.S. Cl.
CPC ..... *G09G 3/3406* (2013.01); *G09G 3/003* (2013.01); *G09G 3/36* (2013.01);
(Continued)

(58) Field of Classification Search
CPC ..... G09G 2320/0209; G09G 3/3406; G09G 3/36; G09G 3/003
(Continued)

(56) References Cited

U.S. PATENT DOCUMENTS 5,608,422 A 3/1997 Ikeda
2005/0212824 A1* 9/2005 Marcinkiewicz .... G09G 3/3406 345/690
(Continued)

FOREIGN PATENT DOCUMENTS

CN 103000144 A 3/2013
CN 103220536 A 7/2013
WO 2011148684 A1 12/2011

OTHER PUBLICATIONS

International search report of PCT Patent Application No. PCT/CN2014/083276 dated Oct. 28, 2014.
(Continued)

*Primary Examiner* — Adam J Snyder

(57) ABSTRACT

Disclosed are an anti-crosstalk method and apparatus for an image of a 3D liquid crystal display apparatus. The method comprises: determining, according to a prestored mapping relationship between a temperature value and backlight on delay duration, backlight on delay duration corresponding to a current temperature value of a 3D liquid crystal display apparatus, performing delay adjustment on a backlight on time node according to the determined delay duration, and controlling a backlight source to be switched on according to the time node after delay adjustment. An on time of a backlight source is correspondingly adjusted at a different temperature, so that time nodes of image switching and switch-on of a backlight are synchronized, thereby reducing the occurrence of a 3D display crosstalk of a 3D liquid crystal display apparatus to enable a user to browse a clearer and more realistic 3D image.

8 Claims, 5 Drawing Sheets

(51) Int. Cl.
*G09G 3/36* (2006.01)
*G09G 3/00* (2006.01)

(52) U.S. Cl.
CPC ..... *G09G 2320/0209* (2013.01); *G09G 2320/041* (2013.01); *G09G 2320/0653* (2013.01)

(58) Field of Classification Search
USPC ..... 345/6
See application file for complete search history.

(56) References Cited

U.S. PATENT DOCUMENTS

2007/0229443 A1 10/2007 Sawada et al.
2011/0175978 A1* 7/2011 Ito ..... H04N 13/0497 348/43
2012/0007969 A1* 1/2012 Lin ..... G09G 3/3406 348/56
2012/0081624 A1* 4/2012 Kobayashi ..... G09G 3/3406 349/15
2012/0105606 A1* 5/2012 Kim ..... G09G 3/342 348/51
2015/0145972 A1* 5/2015 Irie ..... G09G 3/36 348/55

OTHER PUBLICATIONS

Extended European search report of counterpart European Patent Application No. 14867220.7 dated Apr. 25, 2017.

* cited by examiner

ANTI-CROSSTALK METHOD AND APPARATUS FOR IMAGE OF 3D LIQUID CRYSTAL DISPLAY APPARATUS

BACKGROUND

Technical Field

The present invention relates to the field of 3D display, and in particular, to an anti-crosstalk method and apparatus for an image of a 3D liquid crystal display apparatus.

Related Art

Methods for implementing a 3D function in a shutter 3D TV scheme mainly include backlight partition scanning and black field insertion, and no matter which implementation scheme is used, a dominant factor that affects the size of 3D left-and-right-eye image crosstalk (double images or "ghosting" called by professionals appear on a seen image) is a response speed of a liquid crystal screen. The faster the response speed of the liquid crystal screen is, the smaller the 3D crosstalk is, and the better the 3D effect is. The temperature is a key factor that affects the response speed of the liquid crystal screen, with decrease of an environment temperature, the response speed of liquid crystal will decrease accordingly, image switching also slows down accordingly, in a situation where a backlight on time node is unchanged, image switching is not synchronized with the backlight on time node to cause 3D image crosstalk to be serious. For example, 3D image crosstalk at 10 degrees centigrade is 3-6 times the 3D image crosstalk at normal temperatures. In other words, as the temperature becomes lower and lower, the 3D left-and-right-eye image crosstalk is serious, and a 3D image browsed by the audience is less clear.

At present, there is still no way to keep synchronization between image switching of the liquid crystal screen and the backlight on time node at low temperatures.

SUMMARY

A main objective of the present invention is to provide an anti-crosstalk method and apparatus for an image of a 3D liquid crystal display apparatus, aimed at achieving synchronization between time nodes of image switching and switch-on of a backlight and reducing occurrence of 3D display crosstalk of the 3D liquid crystal display apparatus, to enable a user to browse a clearer and more realistic 3D image.

The present invention puts forward an anti-crosstalk method for an image of a 3D liquid crystal display apparatus, the method comprising:

A. acquiring a current temperature value of an area where the 3D liquid crystal display apparatus is located;

B. determining, according to a prestored mapping relationship between a temperature value and backlight on delay duration, backlight on delay duration corresponding to the current temperature value; and C. performing delay adjustment on a backlight on time node according to the determined delay duration, and controlling a backlight source to be switched on according to the time node after delay adjustment.

Preferably, after step A, the method comprises:

A1. judging whether the current temperature value is less than a preset threshold;

A2. when the current temperature value is less than a preset threshold, performing steps B and C; and A3. when the current temperature value is greater than or equal to the preset threshold, performing step A at regular time or in real time.

Preferably, step A comprises:

A4. acquiring temperature values with a particular number of times in a particular position within a preset time; and A5. averaging the acquired temperature values, to obtain the current temperature value.

Preferably, step A comprises:

A6. acquiring current temperature values of a plurality of particular positions; and A7. averaging the acquired temperature values, to obtain the current temperature value of the area where the 3D liquid crystal display apparatus is located.

Preferably, before step A, the method comprises:

D. acquiring 3D display crosstalk data respectively corresponding to a first temperature threshold and a second temperature threshold;

E. determining a mapping relationship between a temperature and the 3D display crosstalk data according to a mapping relationship between backlight on time and the 3D display crosstalk data and the 3D display crosstalk data respectively corresponding to the first temperature threshold and the second temperature threshold; and F. determining and prestoring a mapping relationship between a temperature value and backlight on delay duration according to the mapping relationship between the temperature and the 3D display crosstalk data and the mapping relationship between backlight on time and the 3D display crosstalk data.

The present invention further puts forward an anti-crosstalk apparatus for an image of a 3D liquid crystal display apparatus, the apparatus comprising:

an acquisition module, configured to acquire a current temperature value of an area where the 3D liquid crystal display apparatus is located;

a processing module, configured to determine, according to a prestored mapping relationship between a temperature value and backlight on delay duration, backlight on delay duration corresponding to the current temperature value; and a control module, configured to perform delay adjustment on a backlight on time node according to the determined delay duration, and control a backlight source to be switched on according to the time node after delay adjustment.

Preferably, the apparatus further comprises an analysis module, the analysis module is configured to judge whether the current temperature value is less than a preset threshold;

the processing module is configured to: when the current temperature value is less than a preset threshold, determine, according to a prestored mapping relationship between a temperature value and backlight on delay duration, backlight on delay duration corresponding to the current temperature value, and through the control module, perform delay adjustment on a backlight on time node according to the determined delay duration, and control a backlight source to be switched on according to the time node after delay adjustment; and the acquisition module is configured to: when the current temperature value is greater than or equal to the preset threshold, acquire the current temperature value of the area where the 3D liquid crystal display apparatus is located at regular time or in real time.

Preferably, the acquisition module is configured to acquire temperature values with a particular number of times in a particular position within a preset time; and average the acquired temperature values, to obtain the current temperature value Preferably, the acquisition module is configured to acquire current temperature values of a plurality of particular positions; and average the acquired temperature values, to obtain the current temperature value of the area where the 3D liquid crystal display apparatus is located.

Preferably, the acquisition module is further configured to acquire 3D display crosstalk data respectively corresponding to a first temperature threshold and a second temperature threshold; and the processing module is further configured to determine a mapping relationship between a temperature and the 3D display crosstalk data according to a mapping relationship between backlight on time and the 3D display crosstalk data and the 3D display crosstalk data respectively corresponding to the first temperature threshold and the second temperature threshold; and determine and prestore a mapping relationship between a temperature value and backlight on delay duration according to the mapping relationship between the temperature and the 3D display crosstalk data and the 3D display crosstalk data respectively corresponding to the first temperature threshold and the second temperature threshold.

Compared with the prior art, the present invention determines backlight on delay duration corresponding to the current temperature value of the 3D liquid crystal display apparatus according to a prestored mapping relationship between a temperature value and backlight on delay duration, performs delay adjustment on a backlight on time node according to the determined delay duration, and controls a backlight source to be switched on according to the time node after delay adjustment. An on time of a backlight source is correspondingly adjusted at a different temperature, so that time nodes of image switching and switch-on of a backlight are synchronized, thereby reducing occurrence of a 3D display crosstalk of the 3D liquid crystal display apparatus, to enable a user to browse a clearer and more realistic 3D image.

Implementation of the objective, function characteristics and advantages of the present invention are further described with reference to the accompanying drawings and in combination with embodiments.

DETAILED DESCRIPTION

It should be understood that specific embodiments described herein are merely used to explain the present invention but are not used to limit the present invention.

Figure 1:
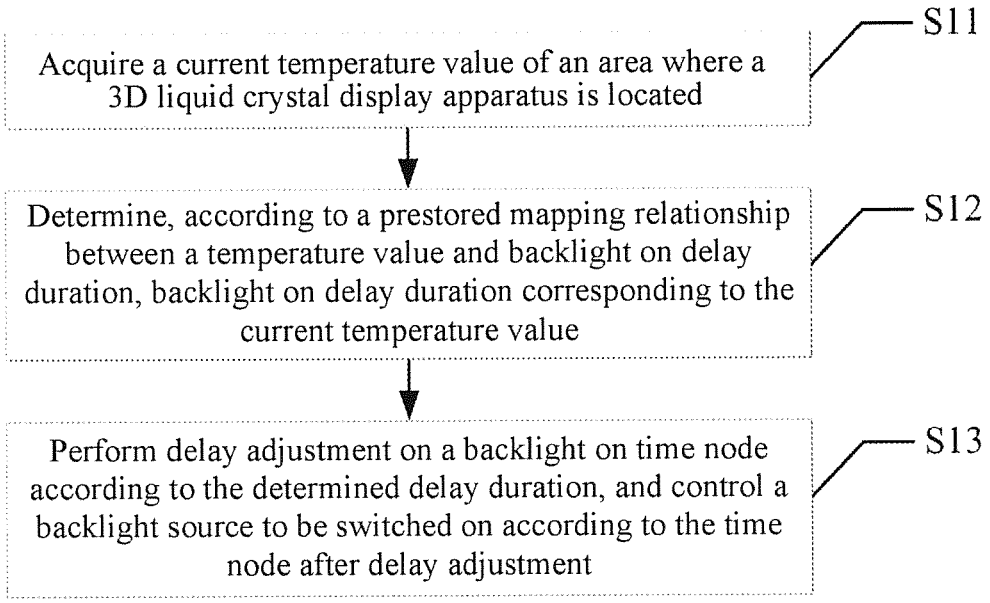
FIG. 1 is a schematic flowchart of a first embodiment of an anti-crosstalk method for an image of a 3D liquid crystal display apparatus according to the present invention.

As shown in FIG. 1, FIG. 1 is a schematic flowchart of a first embodiment of an anti-crosstalk method for an image of a 3D liquid crystal display apparatus according to the present invention.

It should be emphasized that the flowchart shown in FIG. 1 is merely a preferred embodiment, and those skilled in the art should know that any embodiment constructed around the idea of the present invention should not depart from the scope covered by the following technical solution:

acquiring a current temperature value of an area where the 3D liquid crystal display apparatus is located; determining, according to a prestored mapping relationship between a temperature value and backlight on delay duration, backlight on delay duration corresponding to the current temperature value; and performing delay adjustment on a backlight on time node according to the determined delay duration, and controlling a backlight source to be switched on according to the time node after delay adjustment.

The following are specific steps of implementing anti-crosstalk for an image of a 3D liquid crystal display apparatus step by step in this embodiment:

Step S11. Acquire a current temperature value of an area where the 3D liquid crystal display apparatus is located.

Specifically, a temperature sensor is disposed in a particular position of the 3D liquid crystal display apparatus, it should be avoided that the particular position is disposed in the position where a light-emitting device of the 3D liquid crystal display apparatus is located or its vicinity, to prevent heat radiated by the light-emitting device from affecting collection of temperature data, the particular position may be a center position of the 3D liquid crystal display apparatus, a position in four corners or any position except for the position where the light-emitting device of the 3D liquid crystal display apparatus is located and its vicinity, and the number of the particular positions may be one, may also be two, and may also be any other suitable number set by a user in advance, which are not limited one by one herein.

In this embodiment, the manner of implementing the 3D function of the 3D liquid crystal display apparatus is black field insertion, that is, the whole 3D liquid crystal display area is updated from a white field to a black field, or the whole 3D liquid crystal display area is updated from a black field to a white field. Preferably, one particular position is disposed in the 3D liquid crystal display apparatus, that is, preferably, a temperature sensor is disposed in one position. The acquiring a current temperature value of an area where the 3D liquid crystal display apparatus is located is acquiring temperature values with a particular number of times in a particular position within a preset time, and averaging the acquired temperature values, to obtain the current temperature value, and may also be sorting the acquired temperature values in an order from high to low, and averaging the temperature values except the highest temperature value and the lowest temperature value, to obtain the current temperature value. The preset time may be 1 s or 2 s or any other time intervals set by the user in advance, and the particular number of times may be 3 times or 4 times or other suitable number of times set by the user in advance. In other embodiments of the present invention, it is also feasible to dispose a plurality of particular positions in the 3D liquid crystal display apparatus, and the manner of acquiring a current temperature value of an area where the 3D liquid crystal display apparatus is located is as follows: acquiring current temperature values of a plurality of particular positions; and averaging the acquired temperature values, to obtain the current temperature value of the area where the 3D liquid crystal display apparatus is located, or acquiring current temperature values of a plurality of particular positions; and after the highest one and the lowest one in the acquired temperature values are removed, averaging the remaining temperature values, to obtain the current temperature value of the area where the 3D liquid crystal display apparatus is located. In other embodiments of the present invention, the manner of implementing the 3D function of the 3D liquid crystal display apparatus is backlight partition scanning, in which a temperature sensor may be disposed in one particular position of each backlight partition or temperature sensors are disposed in a plurality of particular positions of each backlight partition.

Step S12: Determine, according to a prestored mapping relationship between a temperature value and backlight on delay duration, backlight on delay duration corresponding to the current temperature value.

Step S13: Perform delay adjustment on a backlight on time node according to the determined delay duration, and control a backlight source to be switched on according to the time node after delay adjustment.

Specifically, after the current temperature value of the area where the 3D liquid crystal display apparatus is located is acquired, backlight on delay duration corresponding to the current temperature value is determined according to a prestored mapping relationship between a temperature value and backlight on delay duration, that is, a duration of switch-on of backlight at the current temperature to be delayed relative to a prestored standard backlight on time is obtained; the delay adjustment is performed on the backlight on time node according to the determined delay duration, and the backlight source is controlled to be switched on according to the time node after delay adjustment.

For example, the current temperature value of the area of the 3D liquid crystal display apparatus acquired is 16 degrees, according to a prestored mapping relationship between a temperature value and backlight on delay duration, it is obtained that the backlight on delay duration is 2 ms, and the prestored standard backlight on time is 4 ms, so that the backlight on time is adjusted as 2 ms+4 ms=6 ms, to synchronize time nodes of image switching and switch-on of a backlight.

This embodiment determines backlight on delay duration corresponding to the current temperature value of the 3D liquid crystal display apparatus according to a prestored mapping relationship between a temperature value and backlight on delay duration, performs delay adjustment on a backlight on time node according to the determined delay duration, and controls a backlight source to be switched on according to the time node after delay adjustment. An on time of a backlight source is correspondingly adjusted at a different temperature, so that time nodes of image switching and switch-on of a backlight are synchronized, thereby reducing occurrence of a 3D display crosstalk of the 3D liquid crystal display apparatus, to enable a user to browse a clearer and more realistic 3D image.

Figure 2:
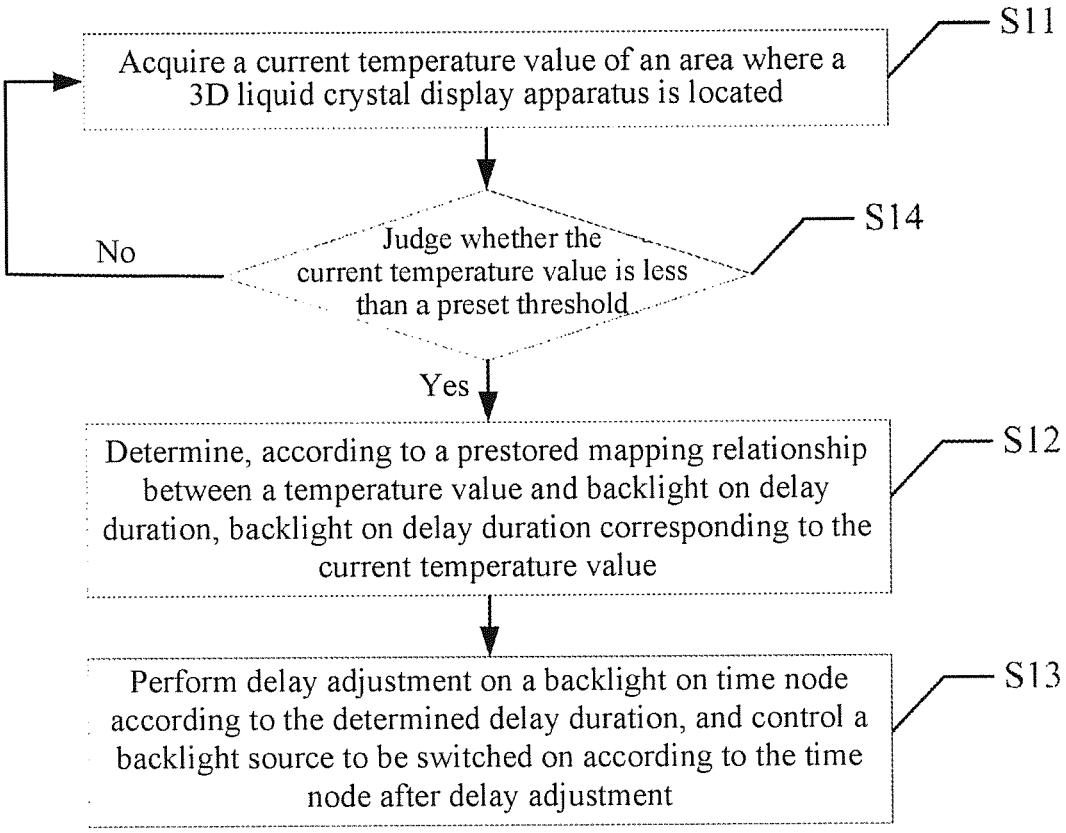
FIG. 2 is a schematic flowchart of a second embodiment of the anti-crosstalk method for an image of a 3D liquid crystal display apparatus according to the present invention.

As shown in FIG. 2, FIG. 2 is a schematic flowchart of a second embodiment of the anti-crosstalk method for an image of a 3D liquid crystal display apparatus according to the present invention.

Based on the first embodiment, after step S11, the method comprises:

Step S14: Judge whether the current temperature value is less than a preset threshold.

Specifically, a response time of liquid crystal varies with a change in the temperature, generally, above a normal temperature (25 degrees), the response speed of the liquid crystal is relatively stable, the response time of liquid crystal will not change evidently with increase of the temperature, but with decrease of the temperature, the response speed of the liquid crystal becomes increasingly slower, and when the temperature is decreased below a certain temperature (10 degrees), the response time of liquid crystal will be close to an image update cycle, the liquid crystal display apparatus cannot work normally, and it is difficult to eliminate influences of decrease of the response speed of the liquid crystal on the display image.

The preset threshold is 25 degrees, when the acquired current temperature is less than the preset threshold, step S12 and step S13 are performed, and when the current temperature is greater than or equal to the preset threshold, the response time of liquid crystal will not change evidently (will not increase evidently), step S11 is performed at regular time or in real time, to obtain the current temperature value of the 3D liquid crystal display apparatus (return to perform step S11, and detect the temperature of the 3D liquid crystal display apparatus in real time or at regular time), so as to adjust backlight on time of the 3D liquid crystal display apparatus.

In this embodiment, the preset threshold of the temperature being 25 degrees is a first threshold, in other embodiments of the present invention, a second threshold of the temperature is set, and the second threshold is 10 degrees (when the 3D liquid crystal display apparatus is at the temperature, the response time of liquid crystal will be close to an image update cycle, and the 3D liquid crystal display apparatus cannot work normally), when the current temperature value is less than the first threshold, whether the current temperature value is greater than the second threshold or not is judged, when the current temperature value is greater than the second threshold, step S12 and step S13 are performed, when the current temperature value is less than the second threshold, it is very difficult to eliminate influences of the response speed of liquid crystal molecules on the image, the backlight on time is adjusted according to the maximum backlight on delay duration obtained by performing step S12 and step S13. The first threshold and the second threshold are determined according to that the liquid crystal has response in an effective temperature interval, that is, when the first threshold is above the corresponding temperature value, the response speed of the liquid crystal will not increase evidently; when the second threshold is below the corresponding temperature value, it is difficult to eliminate influences of the response speed of liquid crystal molecules on the image. In other embodiments of the present invention, it is also feasible to first judge whether the current temperature value is greater than a second threshold, and when the current temperature is greater than the second threshold, judge whether the current temperature is less than the first threshold.

According to this embodiment, whether the current temperature value of the 3D liquid crystal display apparatus is within a preset range is judged, when the acquired current temperature value of the 3D liquid crystal display apparatus is within the preset range, an on time of a backlight source is adjusted, so as to prevent that adjusting the on time of a backlight source according to the acquired current temperature value of the 3D liquid crystal display apparatus not within the preset range results in a problem of non-synchronization of 3D display, thereby further increasing the 3D display effect of the 3D liquid crystal display apparatus.

Figure 3:
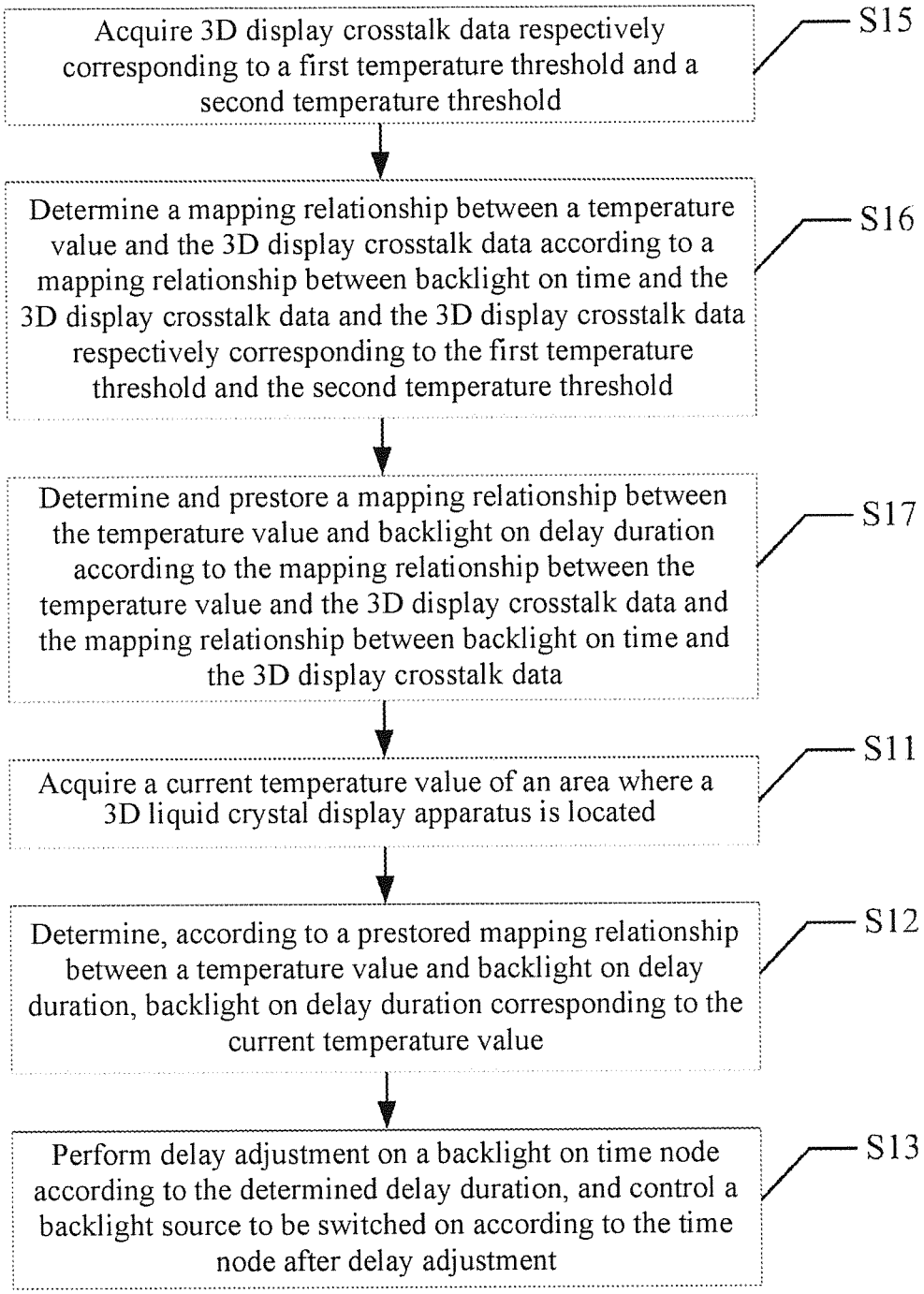
FIG. 3 is a schematic flowchart of a third embodiment of the anti-crosstalk method for an image of a 3D liquid crystal display apparatus according to the present invention.

As shown in FIG. 3, FIG. 3 is a schematic flowchart of a third embodiment of an anti-crosstalk method for an image of a 3D liquid crystal display apparatus according to the present invention.

Based on the first and second embodiments, before step 11, the method further comprises:

Step S15: acquiring 3D display crosstalk data respectively corresponding to a first temperature threshold and a second temperature threshold;

Step S16: determining a mapping relationship between a temperature value and the 3D display crosstalk data according to a mapping relationship between backlight on time and the 3D display crosstalk data and the 3D display crosstalk data respectively corresponding to the first temperature threshold and the second temperature threshold; and Step S17: determining and prestoring a mapping relationship between the temperature value and backlight on delay duration according to the mapping relationship between the temperature value and the 3D display crosstalk data and the mapping relationship between backlight on time and the 3D display crosstalk data.

Specifically, response speeds of liquid crystal of different 3D liquid crystal display apparatuses are different, and influences of temperatures on the response speeds of liquid crystal also vary, it is relatively difficult to accurately obtain a relationship between temperatures and 3D display crosstalk data when each display screen is at different temperatures, which does not facilitate operation. Relatively, when a backlight on time point is unchanged, with decrease of the temperature, the response time of liquid crystal also increases. Therefore, a time interval between the backlight on time point and an image update area also increases. On the contrary, at a certain liquid crystal response time (at a normal temperature of 25 degrees), the backlight on time point is decreased, and the time interval between the backlight on time point and the image update area also increases. Therefore, a relationship of influences of the temperature on the 3D display crosstalk can be converted to a relationship between the backlight on time point and the image update area. Specifically, with decrease of the temperature, the response time of liquid crystal becomes slow, and pixel points for completing image update reflected on an actual display image decrease, that is to say, it takes longer time to complete update of pixel points to be updated for the actual display image, equivalent to that the response time of liquid crystal increases, when the response time of liquid crystal is constant, the backlight on time point is decreased, and the time interval between the backlight on time point and the image update area also increases accordingly; therefore, the relationship of influences of the temperature on the 3D display crosstalk can be converted to a relationship between the temperature and update of pixel points of the image, and further can be converted to a relationship between the backlight on time point and update of pixel points of the image, that is, a relationship between the backlight on time point and an image update area.

Figure 6A:
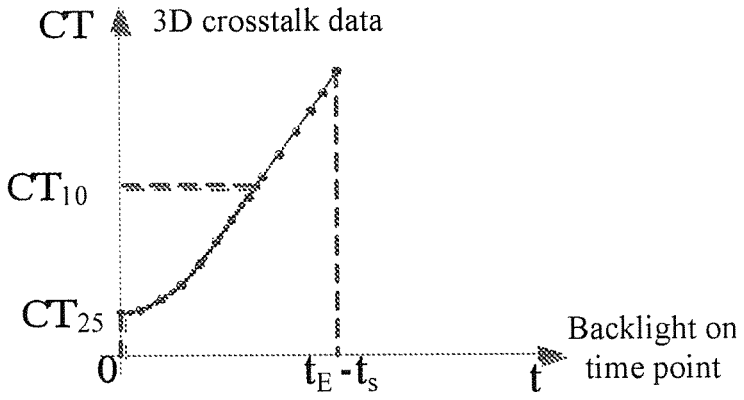
FIG. 6A is a relation curve of a backlight on time point and 3D display crosstalk data according to an embodiment of the present invention.
Figure 6B:
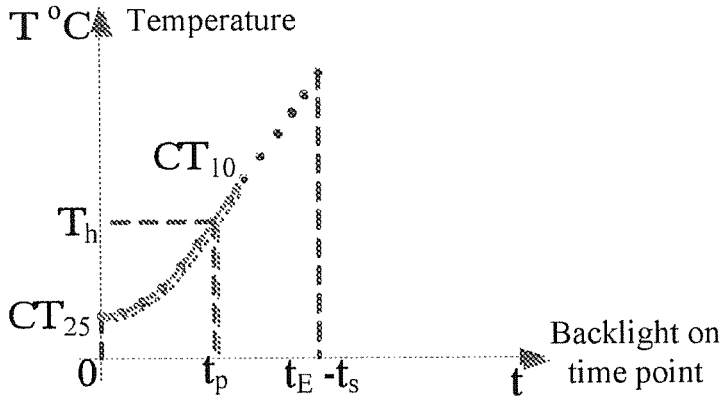
FIG. 6B is a relation curve of a temperature and a backlight on time point according to an embodiment of the present invention.

At a normal temperature (25 degrees), the backlight on time point is adjusted and the size of the corresponding 3D display crosstalk data is acquired, to obtain a mapping relationship between the backlight on time point and the 3D display crosstalk data and obtain a relation curve (as shown in FIG. 6A) between the backlight on time point and the 3D display crosstalk data, two end points of the 3D liquid crystal display apparatus in the relation curve at the first temperature threshold and the second temperature threshold are obtained from the relation curve of FIG. 6A according to 3D display crosstalk data respectively corresponding to the first temperature threshold and the second temperature threshold of the 3D liquid crystal display apparatus, the first temperature threshold and the second temperature threshold are two end points in an effective temperature interval of changes of the response time of liquid crystal, 3D crosstalk data between the end points is 3D crosstalk data of the 3D liquid crystal display apparatus at different temperatures, 3D display crosstalk data corresponding to the first temperature threshold and the second temperature threshold in a different 3D liquid crystal display apparatus is different, according to the 3D display crosstalk data respectively corresponding to the first temperature threshold and the second temperature threshold, a mapping relationship between a temperature value of an area where the 3D liquid crystal display apparatus is located and the 3D display crosstalk data is obtained from a mapping relationship between the backlight on time point and the 3D display crosstalk data, a relation curve between the temperature and the backlight on time point as shown in FIG. 6B is obtained, and a mapping relationship between a temperature value and the backlight on delay duration is determined and prestored according to a mapping relationship between a temperature value and the 3D display crosstalk data and a mapping relationship between the backlight on time point and the 3D display crosstalk data. As the 3D display crosstalk data respectively corresponding to the first temperature threshold and the second temperature threshold of a different 3D liquid crystal display apparatus is different, a mapping relationship between a temperature value of the different 3D liquid crystal display apparatus and backlight on delay duration can be obtained.

In this embodiment, according to a response time of liquid crystal of a different 3D liquid crystal display apparatus and 3D display crosstalk data respectively corresponding to temperature values of two end points in an effective variation interval, a mapping relationship between a temperature value of the different 3D liquid crystal display apparatus and backlight on delay duration is obtained, to adjust an on time of a backlight source according to the acquired current temperature value of the 3D liquid crystal display apparatus, so that time nodes of image switching and switch-on of a backlight are synchronized, thereby reducing occurrence of a 3D display crosstalk of the 3D liquid crystal display apparatus, to enable a user to browse a clearer and more realistic 3D image.

Figure 4:
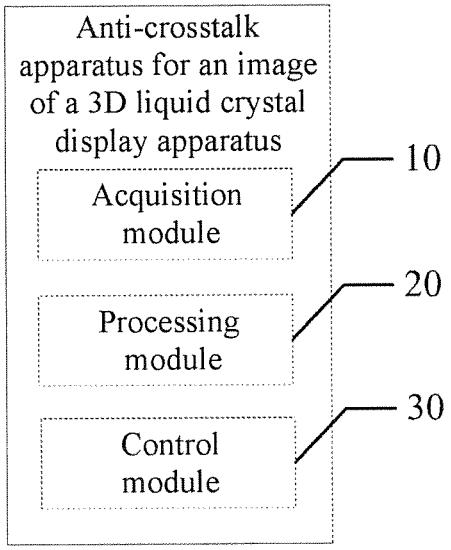
FIG. 4 is a function module diagram of a first embodiment of an anti-crosstalk apparatus for an image of a 3D liquid crystal display apparatus according to the present invention.

As shown in FIG. 4, FIG. 4 is a function module diagram of a first embodiment of an anti-crosstalk apparatus for an image of a 3D liquid crystal display apparatus according to the present invention. The apparatus comprises an acquisition module 10, a processing module 20 and a control module 30.

The acquisition module 10 is configured to acquire a current temperature value of a display area of the 3D liquid crystal display apparatus.

Specifically, a temperature sensor is disposed in a particular position of the 3D liquid crystal display apparatus, to prevent heat radiated by a light-emitting device from affecting collection of temperature data, it should be avoided that the particular position is disposed in the position where the light-emitting device of the 3D liquid crystal display apparatus is located or its vicinity, the particular position may be a center position of the 3D liquid crystal display apparatus, a position in four corners or any position except for the position where the light-emitting device of the 3D liquid crystal display apparatus is located and its vicinity, and the number of the particular position may be one, may also be two, and may also be any other suitable number set by a user in advance, which are not limited one by one herein.

In this embodiment, the manner of implementing the 3D function of the 3D liquid crystal display apparatus is black field insertion, that is, the whole 3D liquid crystal display area is updated from a white field to a black field, or the whole 3D liquid crystal display area is updated from a black field to a white field, preferably, one particular position is disposed in the 3D liquid crystal display apparatus, that is, preferably, a temperature sensor is disposed in one position.

The acquisition module 10 acquires a current temperature value of an area where the 3D liquid crystal display apparatus is located means acquiring temperature values with a particular number of times in a particular position within a preset time, and averaging the acquired temperature values, to obtain the current temperature value, which may also be sorting the acquired temperature values in an order from high to low, and averaging the temperature values except the highest temperature value and the lowest temperature value, to obtain the current temperature value. The preset time may be 1 s or 2 s or any other time intervals set by the user in advance, and the particular number of times may be 3 times or 4 times or other suitable number of times set by the user in advance.

In other embodiments of the present invention, it is also feasible to dispose a plurality of particular positions in the 3D liquid crystal display apparatus, and the manner in which the acquisition module 10 acquires a current temperature value of an area where the 3D liquid crystal display apparatus is located is as follows: the acquisition module 10 acquires current temperature values of a plurality of particular positions; and averages the acquired temperature values, to obtain the current temperature value of the area where the 3D liquid crystal display apparatus is located, or acquires current temperature values of a plurality of particular positions; and after the highest one and the lowest one in the acquired temperature values are removed, averages the remaining temperature values, to obtain the current temperature value of the area where the 3D liquid crystal display apparatus is located. In other embodiments of the present invention, the manner of implementing the 3D function of the 3D liquid crystal display apparatus is backlight partition scanning, and it is feasible to dispose a temperature sensor in one particular position of each backlight partition or dispose temperature sensors in a plurality of particular positions of each backlight partition.

The processing module 20 is configured to determine, according to a prestored mapping relationship between a temperature value and backlight on delay duration, backlight on delay duration corresponding to the current temperature value.

The control module 30 is configured to perform delay adjustment on a backlight on time node according to the determined delay duration, and control a backlight source to be switched on according to the time node after delay adjustment.

Specifically, after the acquisition module 10 acquires the current temperature value of the area where the 3D liquid crystal display apparatus is located, the processing module 20 determines backlight on delay duration corresponding to the current temperature value according to a prestored mapping relationship between a temperature value and backlight on delay duration, that is, obtains a duration of switch-on of backlight at the current temperature to be delayed relative to a prestored standard backlight on time; the control module 30 performs delay adjustment on a backlight on time node according to the determined delay duration, and controls a backlight source to be switched on according to the time node after delay adjustment. For example, the current temperature value of the area of the 3D liquid crystal display apparatus acquired by the acquisition module 10 is 16 degrees, the processing module 20 obtains according to a prestored mapping relationship between a temperature value and backlight on delay duration that backlight on delay duration is 2 ms, and a prestored standard backlight on time is 4 ms, so that the backlight on time is adjusted as 2 ms+4 ms=6 ms, to synchronize image switching with a backlight on time node.

In this embodiment, the processing module 20 determines backlight on delay duration corresponding to the current temperature value of the 3D liquid crystal display apparatus according to a prestored mapping relationship between a temperature value and backlight on delay duration, and the control module 30 performs delay adjustment on a backlight on time node according to the determined delay duration, and controls a backlight source to be switched on according to the time node after delay adjustment. An on time of a backlight source is correspondingly adjusted at a different temperature, so that time nodes of image switching and switch-on of a backlight are synchronized, thereby reducing occurrence of a 3D display crosstalk of the 3D liquid crystal display apparatus, to enable a user to browse a clearer and more realistic 3D image.

Figure 5:
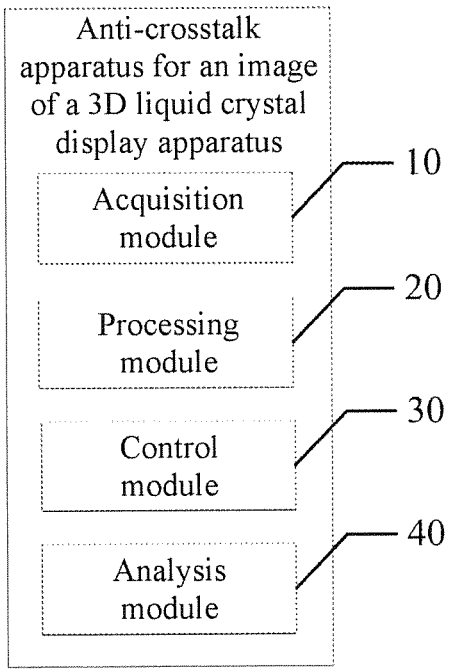
FIG. 5 is a function module diagram of a second embodiment of the anti-crosstalk apparatus for an image of a 3D liquid crystal display apparatus according to the present invention.

As shown in FIG. 5, FIG. 5 is a function module diagram of a second embodiment of an anti-crosstalk apparatus for an image of a 3D liquid crystal display apparatus according to the present invention. The apparatus further comprises an analysis module 40.

The analysis module 40 is configured to judge whether the current temperature value is less than a preset threshold.

The processing module 20 is configured to: when the current temperature value is less than a preset threshold, determine, according to a prestored mapping relationship between a temperature value and backlight on delay duration, backlight on delay duration corresponding to the current temperature value, and through the control module, perform delay adjustment on a backlight on time node according to the determined delay duration, and control a backlight source to be switched on according to the time node after delay adjustment.

The acquisition module 10 is configured to: when the current temperature value is greater than or equal to the preset threshold, acquire the current temperature value of the area where the 3D liquid crystal display apparatus is located at regular time or in real time.

Specifically, a response time of liquid crystal varies with a change in the temperature, generally, above a normal temperature (25 degrees), the response speed of the liquid crystal is relatively stable, the response time of liquid crystal will not change evidently with increase of the temperature, but with decrease of the temperature, the response speed of the liquid crystal becomes increasingly slower, and when the temperature is decreased below a certain temperature (10 degrees), the response time of liquid crystal will be close to an image update cycle, the liquid crystal display apparatus cannot work normally, and it is difficult to eliminate influences of decrease of the response speed of the liquid crystal on the display image.

The preset threshold is 25 degrees, when the acquired current temperature is less than the preset threshold, the processing module 20 determines, according to a prestored mapping relationship between a temperature value and backlight on delay duration, backlight on delay duration corresponding to a current temperature value of a 3D liquid crystal display apparatus, and through the control module 30, performs delay adjustment on a backlight on time node according to the determined delay duration, and controls a backlight source to be switched on according to the time node after delay adjustment; and when the current temperature is greater than or equal to the preset threshold, the response time of the liquid crystal will not change evidently (will not increase evidently), the acquisition module 10 acquires the current temperature value of the area where the 3D liquid crystal display apparatus is located at regular time or in real time, to obtain the current temperature value of the 3D liquid crystal display apparatus, so as to adjust backlight on time of the 3D liquid crystal display apparatus.

In this embodiment, the preset threshold of the temperature being 25 degrees is a first threshold, in other embodiments of the present invention, a second threshold of the temperature is set, the second threshold is 10 degrees (when the 3D liquid crystal display apparatus is at the temperature, the response time of the liquid crystal will be close to an image update cycle, and the 3D liquid crystal display apparatus cannot work normally), when the current temperature value is less than the first threshold, whether the current temperature value is greater than the second threshold or not is judged, when the current temperature value is greater than the second threshold, the processing module 20 determines, according to a prestored mapping relationship between a temperature value and backlight on delay duration, backlight on delay duration corresponding to a current temperature value of a 3D liquid crystal display apparatus, and through the control module 30, performs delay adjustment on a backlight on time node according to the determined delay duration, and controls a backlight source to be switched on according to the time node after delay adjustment; when the current temperature value is less than the second threshold, it is very difficult to eliminate influences of the response speed of liquid crystal molecules on the image, the control module 30 adjusts the backlight on time according to the maximum backlight on delay duration obtained by the processing module 20. The first threshold and the second threshold are determined according to that the liquid crystal has response in an effective temperature interval, that is, when the first threshold is above the corresponding temperature value, the response speed of the liquid crystal will not increase evidently; when the second threshold is below the corresponding temperature value, it is difficult to eliminate influences of the response speed of liquid crystal molecules on the image. In other embodiments of the present invention, it is also feasible that the analysis module 40 first judges whether the current temperature value is greater than a second threshold, and when the current temperature is greater than the second threshold, judges whether the current temperature is less than the first threshold.

According to this embodiment, the analysis module 40 judges whether the acquired current temperature value of the 3D liquid crystal display apparatus is within a preset range, when the acquired current temperature value of the 3D liquid crystal display apparatus is within the preset range, the control module 30 adjusts an on time of a backlight source, so as to prevent that adjusting the on time of a backlight source according to the acquired current temperature value of the 3D liquid crystal display apparatus not within the preset range results in a problem of non-synchronization of 3D display, thereby further increasing the 3D display effect of the 3D liquid crystal display apparatus.

Further, the acquisition module 10 is further configured to acquire 3D display crosstalk data respectively corresponding to a first temperature threshold and a second temperature threshold; and the processing module 20 is further configured to determine a mapping relationship between a temperature value and the 3D display crosstalk data according to a mapping relationship between backlight on time and the 3D display crosstalk data and the 3D display crosstalk data respectively corresponding to the first temperature threshold and the second temperature threshold; and determine and prestore a mapping relationship between the temperature value and backlight on delay duration according to the mapping relationship between the temperature and the 3D display crosstalk data and the first temperature threshold and the second temperature threshold.

Specifically, response speeds of liquid crystal of different 3D liquid crystal display apparatuses are different, and influences of temperatures on the response speeds of liquid crystal also vary, it is relatively difficult to accurately obtain a relationship between temperatures and 3D display crosstalk data when each display screen is at different temperatures, which does not facilitate operation. Relatively, when a backlight on time point is unchanged, with decrease of the temperature, the response time of liquid crystal also increases. Therefore, a time interval between the backlight on time point and an image update area also increases. On the contrary, at a certain liquid crystal response time (at a normal temperature of 25 degrees), the backlight on time point is decreased, and the time interval between the backlight on time point and the image update area also increases. Therefore, a relationship of influences of the temperature on the 3D display crosstalk can be converted to a relationship between the backlight on time point and the image update area. Specifically, with decrease of the temperature, the response time of liquid crystal becomes slow, and pixel points for completing image update reflected on an actual display image decrease, that is to say, it takes longer time to complete update of pixel points to be updated for the actual display image, equivalent to that the response time of liquid crystal increases, when the response time of liquid crystal is constant, the backlight on time point is decreased, and the time interval between the backlight on time point and the image update area also increases accordingly; therefore, the relationship of influences of the temperature on the 3D display crosstalk can be converted to a relationship between the temperature and update of pixel points of the image, and further can be converted to a relationship between the backlight on time point and update of pixel points of the image, that is, a relationship between the backlight on time point and an image update area.

At a normal temperature (25 degrees), the backlight on time point is adjusted and the size of the corresponding 3D display crosstalk data is acquired, to obtain a mapping relationship between the backlight on time point and the 3D display crosstalk data and obtain a relation curve (as shown in FIG. 6A) between the backlight on time point and the 3D display crosstalk data, two end points of the 3D liquid crystal display apparatus in the relation curve at the first temperature threshold and the second temperature threshold are obtained according to 3D display crosstalk data respectively corresponding to the first temperature threshold and the second temperature threshold acquired by the acquisition module 10 of the 3D liquid crystal display apparatus from the relation curve of FIG. 6A, the first temperature threshold and the second temperature threshold are two end points in an effective temperature interval of changes of the response time of liquid crystal, 3D crosstalk data between the end points is 3D crosstalk data of the 3D liquid crystal display apparatus at different temperatures, 3D display crosstalk data corresponding to the first temperature threshold and the second temperature threshold in a different 3D liquid crystal display apparatus is different, according to the 3D display crosstalk data respectively corresponding to the first temperature threshold and the second temperature threshold, the processing module 20 obtains a mapping relationship between a temperature value of an area where the 3D liquid crystal display apparatus is located and the 3D display crosstalk data from a mapping relationship between the backlight on time point and the 3D display crosstalk data, obtains a relation curve between the temperature and the backlight on time point as shown in FIG. 6B, and determines and prestores a mapping relationship between a temperature value and the backlight on delay duration according to a mapping relationship between a temperature value and the 3D display crosstalk data and a mapping relationship between the backlight on time point and the 3D display crosstalk data. As the 3D display crosstalk data respectively corresponding to the first temperature threshold and the second temperature threshold of a different 3D liquid crystal display apparatus is different, a mapping relationship between a temperature value of the different 3D liquid crystal display apparatus and backlight on delay duration can be obtained.

In this embodiment, the processing module 20, according to a response time of liquid crystal of a different 3D liquid crystal display apparatus and 3D display crosstalk data respectively corresponding to temperature values of two end points in an effective variation interval, obtains a mapping relationship between a temperature value of the different 3D liquid crystal display apparatus and backlight on delay duration, to enable the control module 30 to adjust an on time of a backlight source according to the acquired current temperature value of the 3D liquid crystal display apparatus, so that time nodes of image switching and switch-on of a backlight are synchronized, thereby reducing occurrence of a 3D display crosstalk of the 3D liquid crystal display apparatus, to enable a user to browse a clearer and more realistic 3D image.

The above are merely preferred embodiments of the present invention, and do not limit the patent scope of the present invention. Any equivalent structure or equivalent process transformation made according to the contents of the specification and the drawings of the present invention or directly or indirectly applied to other related technical fields should be included in the patent protection scope of the present invention.

What is claimed is:

1. An anti-crosstalk method for an image of a 3D liquid crystal display apparatus, characterized in that, the method comprises:

A. acquiring a current temperature value of an area where the 3D liquid crystal display apparatus is located;

B. determining, according to a prestored mapping relationship between a temperature value and backlight on delay duration, backlight on delay duration corresponding to the current temperature value; and C. performing delay adjustment on a backlight on time node according to the determined delay duration, and controlling a backlight source to be switched on according to the time node after delay adjustment, wherein, before step A, the method further comprises:

D. acquiring 3D display crosstalk data respectively corresponding to a first temperature threshold and a second temperature threshold;

E. determining a mapping relationship between a temperature and the 3D display crosstalk data according to a mapping relationship between backlight on time and the 3D display crosstalk data and the 3D display crosstalk data respectively corresponding to the first temperature threshold and the second temperature threshold; and F. determining and prestoring a mapping relationship between a temperature value and backlight on delay duration according to the mapping relationship between the temperature and the 3D display crosstalk data and the mapping relationship between backlight on time and the 3D display crosstalk data.

2. The anti-crosstalk method for an image of a 3D liquid crystal display apparatus according to claim 1, characterized in that, after step A, the method further comprises:

A1. judging whether the current temperature value is less than a preset threshold;

A2. when the current temperature value is less than a preset threshold, performing steps B and C; and A3. when the current temperature value is greater than or equal to the preset threshold, performing step A at regular time or in real time.

3. The anti-crosstalk method for an image of a 3D liquid crystal display apparatus according to claim 1, characterized in that, step A comprises:

A4. acquiring temperature values with a particular number of times in a particular position within a preset time; and A5. averaging the acquired temperature values, to obtain the current temperature value.

4. The anti-crosstalk method for an image of a 3D liquid crystal display apparatus according to claim 1, characterized in that, the step A comprises:

A6. acquiring current temperature values of a plurality of particular positions; and A7. averaging the acquired temperature values, to obtain the current temperature value of the area where the 3D liquid crystal display apparatus is located.

5. An anti-crosstalk apparatus for an image of a 3D liquid crystal display apparatus, characterized in that, the apparatus comprises:

an acquisition module which being a temperature sensor, configured to acquire a current temperature value of an area where the 3D liquid crystal display apparatus is located;

a processing module which being a prestored mapping, configured to determine, according to a prestored mapping relationship between a temperature value and backlight on delay duration, backlight on delay duration corresponding to the current temperature value; and a control module which being a switch, configured to perform delay adjustment on a backlight on time node according to the determined delay duration, and control a backlight source to be switched on according to the time node after delay adjustment, wherein, the acquisition module is further configured to acquire 3D display crosstalk data respectively corresponding to a first temperature threshold and a second temperature threshold; and the processing module is further configured to determine a mapping relationship between a temperature and the 3D display crosstalk data according to a mapping relationship between backlight on time and the 3D display crosstalk data and the 3D display crosstalk data respectively corresponding to the first temperature threshold and the second temperature threshold; and determine and prestore a mapping relationship between a temperature value and backlight on delay duration according to the mapping relationship between the temperature and the 3D display crosstalk data and the 3D display crosstalk data respectively corresponding to the first temperature threshold and the second temperature threshold.

6. The anti-crosstalk apparatus for an image of a 3D liquid crystal display apparatus according to claim 5, characterized in that, the apparatus further comprises an analysis module, the analysis module is configured to judge whether the current temperature value is less than a preset threshold;

the processing module is configured to: when the current temperature value is less than a preset threshold, determine, according to a prestored mapping relationship between a temperature value and backlight on delay duration, backlight on delay duration corresponding to the current temperature values, and through the control module, perform delay adjustment on a backlight on time node according to the determined delay duration, and control a backlight source to be switched on according to the time node after delay adjustment; and the acquisition module is configured to: when the current temperature value is greater than or equal to the preset threshold, acquire the current temperature value of the area where the 3D liquid crystal display apparatus is located at regular time or in real time.

7. The anti-crosstalk apparatus for an image of a 3D liquid crystal display apparatus according to claim 5, characterized in that, the acquisition module is configured to acquire temperature values with a particular number of times in a particular position within a preset time; and average the acquired temperature values, to obtain the current temperature value.

8. The anti-crosstalk apparatus for an image of a 3D liquid crystal display apparatus according to claim 5, characterized in that, the acquisition module is configured to acquire current temperature values of a plurality of particular positions; and average the acquired temperature values, to obtain the current temperature value of the area where the 3D liquid crystal display apparatus is located.

* * * * *